United States Patent [19]

Sirinyan et al.

[11] Patent Number: 4,563,371

[45] Date of Patent: Jan. 7, 1986

[54] PROCESS FOR PREPARING METALLIZED POROUS SOLID BODIES

[75] Inventors: Kirkor Sirinyan, Bergisch Gladbach; Peter M. Lange; Rudolf Merten, both of Leverkusen; Alfred Mitschker, Odenthal-Holz, all of Fed. Rep. of Germany

[73] Assignee: Bayer Aktiengesellschaft, Leverkusen, Fed. Rep. of Germany

[21] Appl. No.: 565,081

[22] Filed: Dec. 23, 1983

[30] Foreign Application Priority Data

Dec. 31, 1982 [DE] Fed. Rep. of Germany ..... 3248778

[51] Int. Cl.[4] ..... B05D 3/04; B05D 3/10; B05D 1/18; B01J 31/08

[52] U.S. Cl. ..... 427/305; 204/30; 204/38.4; 427/437; 427/438; 502/75; 502/159; 502/185; 502/259; 502/260; 502/326; 521/31; 564/494

[58] Field of Search ..... 502/159, 150, 74, 75, 502/66, 326, 185; 521/31; 204/30; 564/494; 106/1.11; 427/305, 437, 438; 208/38.4

[56] References Cited

U.S. PATENT DOCUMENTS

| | | | |
|---|---|---|---|
| 2,861,045 | 11/1958 | Langer, Jr. | 502/159 |
| 3,013,987 | 12/1961 | Castor et al. | 502/79 |
| 3,222,218 | 12/1965 | Beltzer et al. | 427/304 |
| 3,351,487 | 11/1967 | Levine et al. | 427/304 |
| 3,437,507 | 4/1969 | Jensom | 106/1.11 |
| 3,440,181 | 4/1969 | Olstowski | 502/185 |
| 3,532,518 | 10/1970 | D'Ottavio | 106/1.11 |
| 3,538,019 | 11/1970 | Capik et al. | 502/184 |
| 3,574,763 | 4/1971 | Wollner et al. | 502/159 |
| 3,578,609 | 5/1971 | Haag et al. | 502/159 |
| 3,684,534 | 8/1972 | Emerson | 106/1.11 |
| 3,954,883 | 5/1976 | Haag et al. | 560/231 |
| 3,960,962 | 6/1976 | Shubkin | 502/159 |
| 4,076,622 | 2/1978 | Costin | 424/132 |
| 4,097,286 | 6/1978 | Dafter, Jr. | 204/30 |
| 4,311,812 | 1/1982 | Manziek | 502/159 |
| 4,347,164 | 8/1982 | Scherzer | 502/74 |
| 4,364,803 | 12/1982 | Midola et al. | 204/30 |
| 4,472,458 | 9/1984 | Sirinyan et al. | 427/305 |
| 4,493,861 | 1/1985 | Sirinyan et al. | 427/305 |

*Primary Examiner*—P. E. Konopka

*Attorney, Agent, or Firm*—Sprung, Horn, Kramer & Woods

[57] ABSTRACT

The metallization of porous solid bodies, such as, for example, ion exchange materials, by loading the surfaces of the metal-free substrates with transition metal ions and subsequently treating them with reducing agents can be improved by activating the substrates, before or after the loading with metal ions, with elements of group 1 or 8 of the periodic table or compounds thereof and sensitizing any activating ions still present. The metallization products are useful hydrogenation catalysts.

10 Claims, No Drawings

PROCESS FOR PREPARING METALLIZED POROUS SOLID BODIES

BACKGROUND OF THE INVENTION

Porous solid bodies are becoming increasingly important as adsorbents and catalysts. They differ from other solid bodies in having a hollow structure. This hollow structure is formed by a system of pores. The shape and opening width of these pores ranges from macroscopic recesses and cracks having a diameter of a few μm down to voids having opening widths which are of the order of molecular diameters. The majority of synthetically prepared adsorbents have pores which cover different size ranges and whose size distribution is only rarely homogeneous.

Porous solid bodies are found in numerous chemical families. They include inorganic compounds, such as silicon derivatives, metal oxides, activated carbons and the like, but also porous metals and alloys and partially crosslinked polymers, in particular ion exchange materials.

Porous solid bodies have specific surface areas which are orders of magnitude larger than those of metals. Surface reactions on such solid bodies are consequently accompanied by greater effects. A process with which the chemical nature of the surface or matrix can be changed in a controlled manner by depositing a thin, diffuse coat of metal is therefore of interest.

One of the most important advantages of combining the metal with the hollow geometry of the support material is, for example, that the heat of reaction is simpler to conduct away, by virtue of the high thermal conductivity of the metal, that layer densities and void volumes can be controlled, and that associated pressure losses can be avoided by applying external magnetic fields if used in the form of a fluidized or suspended bed.

The preparation of metallized porous solid bodies is known per se and generally takes the form of loading the porous substrates with ions of transition metals, preferably Ru, Pd, Pt, Ag and Ni, and then treating them with a reducing agent, preferably hydrogen (cf. German Patent Specification No. 1,643,044, German Patent Specification No. 2,553,762, U.S. Pat. No. 3,538,019, U.S. Pat. No. 3,013,987 and East German Patent Specification No. 40,953) or hydrazine, dithionite, boron hydride and the like (cf. German Patent Specification No. 2,849,026, German Patent Specification No. 2,003,522, German Patent Specification No. 18,000,380, French Patent Specification No. 2,270,238, U.S. Pat. No. 4,076,622 Chem. Abstr. 67, 36671 s (1967)) or thermally decomposing the metal compounds applied to the substrates (cf. U.S. Pat. Nos. 3,013,987 and 3,954,883).

These processes, however, have various disadvantages. Their chief defect is that they are not universally applicable. Processes which proceed satisfactorily if, for example, very noble metals, such as Pd and Pt, are used, frequently fail completely when less noble metals, such as Ni and Co, are used.

SUMMARY OF THE INVENTION

It has now been found that virtually all transition metals can be satisfactorily applied to said substrates without significantly impairing the pore structure by activating the substrates with the metal ions of the elements of group 1 or 8 of the periodic table or compounds thereof before or after the loading with transition metal ions and sensitizing any activating ions still present with, for example, an $SnCl_2$ solution.

The process according to the invention is generally carried out as follows:

First, porous solid bodies are loaded with the metal ions to be reduced. The loading can be effected by customary methods. The loading with metal ions is possible not only in aqueous but also in organic media. Metal ions which can be used in the process according to the invention are in particular Cu, Ag, Au, Ni, Fe, Co, Pd and Pt or mixtures thereof. Co and in particular Ni are preferred. The loaded solid bodies are washed and, if appropriate, freed from solvents or excess metal ions.

The activation is possible not only with ionic and/or colloidal but also with organic adducts of elements of groups I and VIII of the periodic table, of which the elements Au, Ag, Pd, Pt and Cu are used particularly preferably. Their amount per liter of solvent should be 0.1–15 g, the amounts of 0.3–1.5 g/liter being used particularly preferably.

The preferred activating metal is palladium in the form of a sol or in particular in the form of a metallo-organic compound.

DETAILED DESCRIPTION OF THE INVENTION

The groups of the organic moiety of the metalloorganic compounds which re required to bond the metal are known per se (cf. German Patent Specification No. 3,025,307). They are, for example, C—C or —C—N double and triple bonds and groups which can form a chelate complex, for example OH, SH, CO or COOH groups. The use of metallo-organic compounds which, in addition to the groups necessary for bonding the metal, also have at least one further functional group has the advantage that superior fixing of the activating seeds to the substrate surface is obtained.

Particularly suitable for fixing the activator to the substrate surface are functional groups such as carboxylic acid groups, carboxylic acid halide groups, carboxylic acid hydride groups, carboxylic acid ester groups, carboxamide and carboximide groups, aldehyde and ketone groups, ether groups, sulphonic acid halide groups, sulphonic acid ester groups, halogen-containing heterocyclic radicals, such as chlorotriazinyl, chloropyrazinyl, chloropyrimidinyl or chloroquinoxalinyl groups, activated double bonds, such as in vinylsulphonic acid or acrylic acid derivatives, amino groups, hydroxyl groups, isocyanate groups, olefine groups and acetylene groups and mercapto groups and epoxy groups, and also longer-chain alkyl or alkenyl radicals from $C_8$, in particular oleic, linoleic, stearic or palmitic groups.

The organometallic activators are used in the form of a solution, dispersion, emulsion or suspension in an organic solvent or as a mixture with an organic solvent. Solvent mixtures can also be used. However, it is not advisable to incorporate polymers, prepolymers or other film-forming systems into these solvents.

Suitable solvents are in particular polar, protic and aprotic solvents, such as water, methylene chloride, chloroform, trichloroethylene, perchloroethylene, acetone, ethylene glycol and tetrahydrofuran, which can be blended with other solvents, such as petrol, ligroin, toluene and the like.

The matrices of the substrates to be metallized are wetted with these solutions, preferably for 1 second to 20 minutes. The wetting is particularly suitably done by dipping the particles into the solutions or spraying them with the activating solutions.

The solvent is removed after the wetting. Low-boiling solvents can preferably be removed by evaporating, for example in vacuo. In the case of higher-boiling solvents, other methods, such as extraction with a solvent in which the organic compounds are insoluble, are advisable.

The activation can also be carried out before the loading with metal ions. The surfaces thus pretreated may need to be sensitised.

The solid bodies thus activated can be used as they are in the currentless metalization. However, it may also be necessary to free the surface from sensitizing agent residues by rinsing.

The metalization is preferably carried out in an aqueous solution. Other solvents, such as alcohols, ethers or hydrocarbons, can also be used. Moreover, it is also possible to use suspensions of the reducing agents. Possible reducing agents are preferably alkali metal boranes, dimethylaminoboranes, diethylaminoboranes, alkali metal hypophosphite or formalin or mixtures thereof. Their amounts should preferably be 10–200 g/liter, and can be, in special cases, higher or lower. The reduction can be carried out at temperatures of −15° C. to the respective boiling point of the solvent, room temperature being particularly preferred. The reducing baths can be mixed in special cases with complexing agents, such as citrate ions (sodium citrate, ammonium citrate or citric acid) and ammonium cations ($NH_4OH$ or $NH_4Cl$) or ammonia.

Any known porous solid body having a surface area of 1–2,000 $m^2/g$ is suitable, in principle, for carrying out the new process. Examples which may be mentioned in this context are those based on $SiO_2$, activated carbon, metal oxides and organic polymers, such as polystyrene, divinylbenzene, polyurethane, polyisoprene, polybutadiene, polyvinyl chloride, polyvinylpyridine, phenolic resins and epoxy resins.

Those porous solid bodies which contain anchor groups or chelating agents suitable for fixing ions, such as

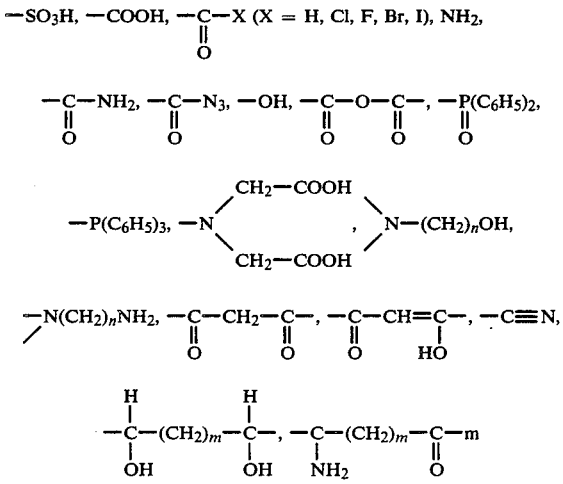

-continued

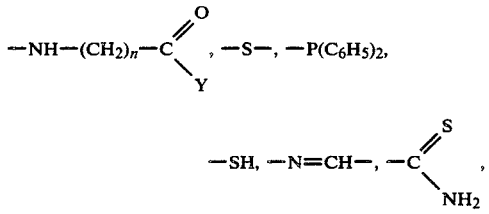

where n=0–6, m=1–6 and

Y=OH, Cl, F, Br or I, are particularly preferably used for carrying out the process according to the invention.

In this context may be mentioned the commercially available zwitter-ionic ion exchange materials and acid, neutral or basic ion exchange materials, snake in cage resins, mosaic resins, interpenetrating network resins or combinations thereof.

The metal content of the solid bodies loaded by the process according to the invention should be 5–95% by weight.

EXAMPLE 1

5 g of macroporous solid bodies based on styrene/DVB (divinylbenzene) and having an effective particle size of about 0.5 mm and chelating imine diacetate anchor groups are loaded with $Ni^{2+}$ ions by treating them with weakly acid 10% strength $NiSO_4$ solution (pH~4), are washed with distilled water, are dried at 40° C. in a drying cabinet overnight, are activated in an activating bath of 0.7 g of 4-cyclohexene-1,2-dicarboxylic anhydride palladium dichloride in 500 ml of methylene chloride in the course of 5 minutes, are dried at room temperature and are then metallized in a reducing bath of 2.0 g of citric acid, 0.35 g of boric acid, 5.0 g of dimethylaminoborane and 85 ml of distilled water in the course of 50 minutes. This produces a metallized material whose pore structure is not affected by the applied metal.

5 g of the above metallized solid bodies were admixed in an autoclave with 80 ml of ethanol and 12.31 g of nitrobenzene, and the mixture was stirred at 100° C. under 100 bar of $H_2$ pressure until the pressure was constant, which took 3 hours, and was then cooled. When the solid body had been filtered off, nitrobenzene could no longer be detected in the filtrate by gas chromatography. The nitrobenzene added had been reduced to aniline.

EXAMPLE 2

7.5 g of strongly acid macroporous solid bodies which are in the hydrogen form and have a matrix crosslinked with about 18% of DVB, a bulk density of ~800 g/liter, an effective particle size of 0.6 mm and sulphonic acid anchor groups are loaded with $Cu^{2+}$ ions by treating them with a weakly sulphuric acid solution of $CuSO_4$, are washed with distilled water, are dried and then activated in an activating bath of 0.65 g of butadiene palladium dichloride and 1,500 ml of 1,1,1-trichloroethane in the course of 5 minutes, are dried at 50° C. in a drying cabinet, and are then metallized at 30° C. in a reducing bath of 1.2 g of formalin, 1.5 g of boric acid, 1.75 g of tartaric acid and 82 ml of distilled water in the course of 80 minutes. This produces a porous metallized sample material whose hollow structure is not changed by the metal.

EXAMPLE 3

10 g of macroporous solid bodies as described in Example 1 are loaded with $Co^{2+}$ ions by treating them with weakly acid aqueous 8% strength $CoSO_4$ solution (pH ~ 5), are dried as described in Example 1, are activated, and are then metallized in a reducing bath as described in Example 1. This produces a fully metallized sample material whose porous structure is not affected by the applied metal.

10 g of the above, metallized solid bodies were admixed in an autoclave with 160 ml of ethanol and 24.62 g of nitrobenzene, and the mixture was stirred at 100° C. under 100 bar of $H_2$ pressure until the pressure was constant, which took 2.5 hours. When the reaction medium had been discharged and the porous solid bodies had been filtered off, the reaction solution was analyzed by gas chromatography. The analyses showed that the nitrobenzene added had been reduced to aniline.

EXAMPLE 4

10 g of strongly acid macroporous solid bodies which are in the hydrogen form and have a matrix crosslinked with about 18% of DVB, an effective particle size of 0.48 mm and $SO_3H$ anchor groups are loaded with Co ions by treating them with weakly acid $CoCl_2$ solution (pH ~ 5), are washed with distilled water and then with methanol, are activated as described in Example 1 and are then metallized at room temperature in a reducing bath of 5.7 g of dimethylaminoborane and 90 g of distilled water in the course of 30 minutes. This gives a porous metallized sample material.

EXAMPLE 5

10 g of macroporous solid bodies as described in Example 4 are loaded with $Ni^{2+}$ ions as described in Example 1, are activated as described in Example 2, are dried, and are then metallized at 60° C. in a reducing bath of 15 g of dimethylaminoborane and 82 g of distilled water in the course of 45 minutes. This produces a macroporous sample material which has been metallized not only at the surface but also in the matrix.

10 g of the above, metallized solid bodies are admixed in an autoclave with 160 ml of ethanol and 24.62 g of nitrobenzene, and the mixture is hydrogenated as described in Example 4. It was possible to show by gas chromatography that the nitrobenzene had been converted into aniline in a 100% yield.

EXAMPLE 6

10 g of macroporous solid bodies as described in Example 1 are loaded with $Co^{2+}$ ions by treating them with weakly acid aqueous 8% strength $CoSO_4$ solution (pH ~ 5), are dried as described in Example 1, are activated with a commercially available colloidal Pd activator, are sensitized with a hydrochloric acid solution of $SnCl_2$ (pH ~ 2), are washed with distilled water, and are then metallized in a reducing bath as described in Example 1. This produces a fully metallised sample material whose porous structure is not affected by the applied metal.

EXAMPLE 7

10 g of the solid bodies listed in Example 1 are loaded with $Ni^{2+}$ and $Co^{2+}$ ions by treating them at room temperature with a weakly acid aqueous salt solution of 3% $NiSO_4$ and 9% $CoCl_2$, and are then metallized as described in Example 4. This produces a porous sample material which has been metallized at the surface and in the matrix.

EXAMPLE 8

10 g of the macroporous solid bodies listed in Example 1 are loaded with $Co^{2+}$ ions as described in Example 3, are activated as described in Example 1 and are then given a macroporous coating of metal by treating them at room temperature in a reducing bath which consists of 15 g of sodium hypophosphite, 17 g of $(NH_4)_2SO_4$ and 200 ml of distilled water in the course of 35 minutes.

EXAMPLE 9

10 g of the porous solid bodies described in Example 2 are loaded with $Ni^{2+}$ ions as described in Example 1, are activated in the course of 2 minutes in an activating bath which consists of 0.7 g of 1,5-cyclooctadiene palladium chloride and 1 liter of trichloroethane, are washed with methanol, and are then metallised at 40° C. in a reducing agent of 23 g of dimethylaminoborane, 21 g of malonic acid, 15 g of $(NH_4)_2SO_4$ in the course of 45 minutes. This produces a porous metallized sample material.

EXAMPLE 10

50 g of commercially available silica gel having a particle size distribution from 0.2 to 0.5 mm are loaded by treating them with neutral aqueous 10% strength $NiCl_2$ solution, are dried in vacuo at 50° C., are activated as described in Example 1, and are then metallized as described in Example 5. This gives a porous metallized sample material having a metal content of 6% by weight.

EXAMPLE 11

50 g of the porous solid bodies described in Example 10 are loaded by treating them with neutral aqueous 15% strength $CuSO_4$ solution, are dried in vacuo at 50° C., are activated as described in Example 9, and are then metallized in a reducing bath as described in Example 2. This produces a porous metallized sample material having a metal content of 8% by weight.

We claim:

1. In a process for preparing a metallized porous solid body including loading the surfaces of a metal-free porous solid body substrate with Ni or Co ions and conducting activation with a collodial metal activating solution containing palladium or an organometallic activating solution containing palladium, wherein the improvement comprises activating the substrates after said loading and subsequently contacting said substrates with a reducing bath containing 10 to 200 g/liter of a reducing agent and wherein said reducing bath consists essentially of solvent and reducing agent or solvent, reducing agent and complexing agent.

2. A process according to claim 1, which further comprising sensitizing activating palladium remaining after said activation.

3. A process according to claim 2, wherein said sensitizing is effected by a $SnCl_2$ solution.

4. A process according to claim 1, wherein said solution of palladium comprises compounds having in addition to groups necessary for bonding to said Ni or Co at least one further functional group for anchoring said compound to said substrate.

5. A process according to claim 1, wherein said porous solid body substrate is an ion exchange material.

6. A process according to claim 1, wherein the porous solid body substrate contain anchor groups suitable for fixing ions, said anchor groups including $-SO_3N$, $-COOH$, $-\underset{\underset{O}{\|}}{C}-X$ (where X is H, Cl, F, Br, or I), $NH_2$, $-\underset{\underset{O}{\|}}{C}-NH_2$, $-\underset{\underset{O}{\|}}{C}-N_3$, $-OH$, $-\underset{\underset{O}{\|}}{C}-O-\underset{\underset{O}{\|}}{C}-$, $-\underset{\underset{O}{\|}}{P}(C_6H_5)_2$, $$-P(C_6H_5)_3,\ -N\begin{matrix}\diagup CH_2-COOH \\ \diagdown CH_2-COOH\end{matrix},$$

where n is 0 to 6, m is 1 to 6, and

Y is OH, Cl, F, Br or I.

7. A process according to claim 1, wherein the metal content is 5 to 95% by weight of the total weight of the resultant metallized solid body.

8. Metallized porous solid bodies obtained by the process of claim 1.

9. A process according to claim 1, wherein said reducing agent is selected from the group consisting of alkali metal boranes, dimethyl-aminoboranes, diethylaminoboranes, alkali metal hypophosphites, formalins and mixtures thereof.

10. A process according to claim 9, wherein said complexing agent is selected from the group consisting of sodium citrate, ammonium citrate, citric acid, $NH_4OH$, $NH_4Cl$ and ammonia.

* * * * *

UNITED STATES PATENT AND TRADEMARK OFFICE

CERTIFICATE OF CORRECTION

PATENT NO. : 4,563,371

DATED : January 7, 1986

INVENTOR(S) : Kirkor Sirinyan, et al.

It is certified that error appears in the above-identified patent and that said Letters Patent is hereby corrected as shown below:

| | |
|---|---|
| Title Page, under "U.S. Patent Documents" | Line 5, delete "Jensom" and substitute --Jensen--<br>Line 18, delete "Midola" and substitute --Nidola-- |
| Col. 2, line 30 | Delete "re" and substitute --are-- |
| Col. 7, line 7 | Delete "$-SO_3N$" and substitute -- $-SO_3H$-- |
| Col. 7, line 21 | After last formula insert: |

-- $=N-(CH_2)_nOH$, $=N(CH_2)_nNH_2$, $-\underset{\underset{O}{\|}}{C}-CH_2-\underset{\underset{O}{\|}}{C}-$, $-\underset{\underset{O}{\|}}{C}-CH=\underset{\underset{HO}{\|}}{C}-$, $-C\equiv N$, $-\overset{\overset{H}{|}}{\underset{\underset{OH}{|}}{C}}-(CH_2)_m-\overset{\overset{H}{|}}{\underset{\underset{OH}{|}}{C}}-$, $-\underset{\underset{NH_2}{|}}{C}-(CH_2)_m-\underset{\underset{O}{\|}}{C}-m$

UNITED STATES PATENT AND TRADEMARK OFFICE

CERTIFICATE OF CORRECTION

PATENT NO. : 4,563,371

DATED : January 7, 1986

INVENTOR(S) : Kirkor Sirinyan, et al.

It is certified that error appears in the above-identified patent and that said Letters Patent is hereby corrected as shown below:

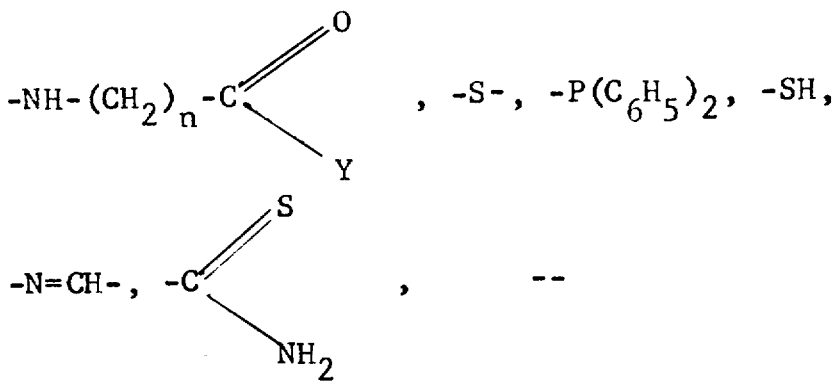

Signed and Sealed this

Twentieth Day of May 1986

[SEAL]

Attest:

DONALD J. QUIGG

Attesting Officer

Commissioner of Patents and Trademarks